United States Patent [19]

McKinney et al.

[11] Patent Number: 4,758,465

[45] Date of Patent: Jul. 19, 1988

[54] LIGHTWEIGHT TENTING FABRIC

[75] Inventors: James M. McKinney, N. Augusta; John S. Russell, Aiken; Richard D. Samson, N. Augusta, all of S.C.

[73] Assignee: Graniteville Company, Graniteville, S.C.

[21] Appl. No.: 170

[22] Filed: Jan. 2, 1987

[51] Int. Cl.[4] ..... B32B 7/00

[52] U.S. Cl. ..... 428/252; 427/393.3; 427/412; 428/265; 428/267; 428/423.5; 428/424.6; 428/921

[58] Field of Search ..... 428/252, 265, 267, 423.5, 428/424.6, 921; 427/412, 393.3

[56] References Cited

U.S. PATENT DOCUMENTS 4,284,682 8/1981 Frosch et al. ..... 428/265

4,594,286 6/1986 McKinney et al. ..... 428/265

*Primary Examiner*—Marion C. McCamish

*Attorney, Agent, or Firm*—Clifton Ted Hunt

[57] ABSTRACT

A lightweight coated fabric weighing no more than 7 ounces per square yard which is resistant to fire, abrasion, water, mildew, and ultraviolet degradation, has a base coat of a urethane binder and fire retardants on both surfaces of a woven synthetic substrate and a top coat bonded to the base coat on both surfaces and containing a polyvinyl chloride binder, fire retardants and chemical compositions resistant to water and ultraviolet degradation.

12 Claims, No Drawings

LIGHTWEIGHT TENTING FABRIC

BACKGROUND OF THE INVENTION

It is known in the prior art to provide lightweight fabrics which are resistant to abrasion, flame, mildew, and ultra-violet degradation. Fabrics having these properties and weighing less than one (1) pound per square yard have been satisfactorily used in military tents.

See, for example, U.S. Pat. No. 4,594,286 issued June 10, 1986, to Graniteville Company of Graniteville, S.C., upon application of James M. McKinney and John G. Hodson for COATED FABRIC. The coated fabric of that patent comprises a substrate of essentially untwisted continuous multifilament synthetic yarns tightly woven into a fabric which is permeated with a liquid coating containing flame retardant chemicals, a polymeric binder, and a thermosetting blocked urethane prepolymer applied to the woven substrate and cured by heat to provide a product having the requisite properties of tear resistance, abrasion resistance, water repellance and flame retardance for use as military tents, and weighing about 13 ounces per square yard. The fabric of the present invention has the same functional properties, but weighs less than half as much—only about 6.3 ounces per square yard.

U.S. Pat. No. 4,594,286 discloses as prior art, beginning in Column 1, line 11, an unpatented coated tent fabric manufactured by Graniteville Company of Graniteville, S.C. under its Product Code 990081. That fabtric comprises a polyester substrate impregnated with a coating of polyvinyl chloride polymer, chlorinated paraffin (40 percent chlorine), chlorinated paraffin (70% chlorine), 2-ethylhexyl diphenyl phosphate plastisizer, antimony trioxide, zinc oxide, decabromodiphenyloxide, zirconium wax complex, epoxy resin, barium-cadmium, fumed silica and pigments. Graniteville's said Product Code 990081 coated fabric weighs about thirteen (13) ounces per square yard, and required better film integrity abrasion and flake resistance for an improved product life.

U.S. Pat. No. 4,284,682 issued Aug. 18, 1981 for HEAT SEALABLE, FLAME AND ABRASION RESISTANT COATED FABRIC upon application of Richard P. Tschirch, et al. discloses a coated nylon fabric weighing 7-½ ounces per square yard and coated on both sides with the same solution of thermoplastic polyester-polyurethane polymer mixed with decabromodiphenyloxide, antimony oxide and amonium polyphosphate. These mixtures were dissolved in tetrahydrofuran to form a solution containing about 40% solids. The solutions of polymer/flame retardant additive were cast into films on silicon release paper and the solvent evaporated. These films were then heat bonded to both sides of 0.9 ounce woven nylon fabric. A film of the same solution was also bonded to only one side of 2.2 ounce woven nylon fabric giving a total weight of 5 to 5-½ ounces and to only one side of 0.9 ounce woven nylon fabric giving a total weight of 4-½ ounces. The fabrics of U.S. Pat. No. 4,284,682 were designed for the construction of clothing and containers for space exploration, but they lack the overall properties required for military tent fabrics.

SUMMARY OF THE INVENTION

The fabric of this invention was developed to meet a military need for a lightweight all-climate tent fabric satisfying the following target requirements:

TARGET REQUIREMENTS FOR LIGHTWEIGHT MILITARY TENTAGE

| TEST | | REQUIREMENTS |
|---|---|---|
| Weight (ounces per square yard) | | 4–7 |
| Breaking Strength (pounds) (Grab) | MD[1] | 104 Minimum |
| | CD[1] | 88 Minimum |
| Tearing Strength (pounds) (Elmendorf) | MD | 6.0 Minimum |
| | CD | 6.0 Minimum |
| Spray Rating Initial | | 80 Minimum |
| Hydrostat Height (cm) Initial | | 45.0 Minimum |
| After cold crack (−40° F.) | | 25 Minimum |
| Appearance after cold crack | | No visible cracks |
| Flame Test (Federal Test Method 5903) Initial | | |
| After Flame (seconds) | MD | 2.0 Maximum |
| | CD | 2.0 Maximum |
| Char Length (inches) | MD | 5.0 Maximum[2] |
| | CD | 5.0 Maximum[2] |
| After 3 Washes (Federal Test Method 5556) | | |
| After Flame (seconds) | MD | 2.0 Maximum |
| | CD | 2.0 Maximum |
| Char Length (inches) | MD | 5.0 Maximum[2] |
| | CD | 5.0 Maximum[2] |
| Flame Test (Federal Test Method 5905) | | |
| After Flame (seconds) | MD | 2.0 Maximum |
| | CD | 2.0 Maximum |
| Percent Consumed | MD | 50 Maximum |
| | CD | 50 Maximum |
| Crock (Federal Test Method 5651) | | 2.0 Minimum |
| Dry | | 2.0 Minimum |
| Wet | | 2.0 Minimum |
| Flexibility | | The fabric shall be flexible at low temperatures, low in bulk, and be able to use standard fabric fabrication techniques. Numerical values are to be established. |
| Color | | Olive drab on one side and white on the other side |

[1]MD means machine direction.
CD means cross machine direction.
[2]It is expected that char length requirements for lightweight synthetics will be adjusted upwardly.

The coated fabric of the present invention utilizes combinations of polymeric binders, flame retardants, plasticizers, pigments and other compounding ingredients to achieve a balance of critical properties not heretofore known in the art of flame retardant fabrics.

Nylon fabrics are more difficult to control regarding melt drip and in obtaining adequate adhesion and film integrity than polyester fabrics. Nylon fiber, however, by its nature, contributes more to reasonable Elmendorf tear properties than equivalent weight and construction of polyester fiber.

210 denier nylon tightly woven into a fabric containing 38 warp yarns per inch and 38 filling yarns per inch in a plain weave weighing 2.21 ounces per square yard has been found to provide a satisfactory substrate. In one satisfactory embodiment of the invention, a base coat with fire retardant chemicals and a urethane binder and a top coat with a polyvinyl chloride flame retardant binder on each side of the fabric successfully obtained the overall properties enumerated above. Briefly, the base coat on each side of the fabric provides the requisite adhesion and durability against abrasion and tearing while the top coat on each side of the fabric provides the requisite resistance to flamability.

DETAILED DESCRIPTION OF THE INVENTION

As in Graniteville U.S. Pat. No. 4,594,286, the fabric of the present invention is structured to meet all of the practical needs of a tent fabric in all climates of the world. The fabric of this invention has the additional advantage of weighing less than half as much as the aforesaid fabric of U.S. Pat. No. 4,594,286. The logistical advantages of such a durable fabric weighing less than 7 ounces per square yard are obvious.

This remarkably strong, durable and lightweight fabric comprises a fabric substrate with a base coat and a top coat applied to each surface. A preferred substrate comprises 210 denier nylon tightly woven into a fabric containing about 38 warp yarns per inch and about 38 filling yarns per inch in a plain weave. The base coat applied to each side of the substrate may contain more than sixty percent (60%) flame retardants but the base coats also include a sufficient amount of urethane binder to provide the requisite film integrity for the desired adhesion of the coating to the substrate and the desired resistance to abrasion.

The top coat applied over the base coat on each surface of the substrate may also contain more than sixty percent (60%) flame retardants and additionally contains a polyvinyl chloride polymer as a flame retardant binder and other components which provide the other desired properties for tent fabric, namely, resistance to water, mildew and ultraviolet degradation.

Several formulations have been devised for the base coat and each of the following examples has been tested and found to be satisfactory on the above described nylon substrate with a top coat of the type aforesaid (and more specifically described in Table E) to produce a lightweight fabric satisfying the aforesaid requirements for lightweight military tentage. Satisfactory base coat formulations are set forth in Tables A, B, C, and D:

TABLE A

| COMPONENT | PERCENT | FUNCTION |
|---|---|---|
| Polyester Urethane | 25.00 | Binder |
| Antimony Oxide | 25.00 | Flame Retardant |
| Decabromodiphenyl Oxide | 35.74 | Flame Retardant |
| Pigment System (infra red Green or White) | 7.13 | Color and infra red properties |
| Di (2-ethylhexyl phthalate) | 7.13 | Plasticizer-Pigment |
| | 100.00 | Grind |

TABLE B

| COMPONENT | PERCENT | FUNCTION |
|---|---|---|
| Polyether Urethane | 10.8 | Binder |
| Decabromodiphenyl Oxide | 30.5 | Flame Retardant |
| Antimony Oxide | 21.0 | Flame Retardant |
| Zinc Borate | 13.9 | Flame Retardant |
| Polymeric Polyisocyanate | 1.6 | Adhesion Promoter |
| Pigment System (infra red Green or White) | 13.9 | Color and infra red properties |
| Dipropylene Glycol | 8.3 | Plasticizer |
| Dibenzoate | 100.0 | |

TABLE C

| COMPONENT | PERCENT | FUNCTION |
|---|---|---|
| "Blocked" Polyester Polyurethane Prepolymer | 5.00 | Binder |
| Antimony Oxide | 25.00 | Flame Retardant |
| Decabromodiphenyl Oxide | 35.74 | Flame Retardant |
| Pigment System (infra red Green or White) | 7.13 | Color and infra red properties |
| Di (2-ethylhexyl phthalate) | 7.13 | Plasticizer-Pigment |
| | 100.00 | Grind |

TABLE D

| COMPONENT | PERCENT | FUNCTION |
|---|---|---|
| "Blocked" Polyester Polyurethane Prepolymer | 10.80 | Binder |
| Decabromodiphenyl Oxide | 30.5 | Flame Retardant |
| Antimony Oxide | 21.0 | Flame Retardant |
| Zinc Borate | 13.9 | Color and infra red properties |
| Polymeric Polyisocyanate | 1.6 | Adhesion Promoter |
| Pigment System (infra red Green or White) | 13.9 | Flame Retardant |
| Dipropylene Glycol | 8.3 | Plasticizer |
| Dibenzoate | 100.00 | |

In the compositions of Tables C and D, the ambient moisture may be used to effect the crosslinking following the "un-blocking" of the isocyanate terminals with heat. This allows the regenerated isocyanate terminals a greater opportunity to react with active hydrogen sites on the substrate and promote better adhesion.

It is also feasible to use cure agents to crosslink and/or chain-extend the urethane prepolymer after unblocking. Effective cure agents include N,N,N$^1$,N$^1$-tetrakis(2-hydroxypropyl)ethylene diamine, triisopropanolamine, triethanolamine, diethanolamine, diisopropanolamine, phenyl diethanolamine, dichlorobenzidine, trimethylolpropane, (bis[p-aminocyclohexyl]methane), and methylene dianiline.

The cure agents are used in such quantities as to provide for ratios in equivalents of total isocyanate to that of reactive hydrogen values, which are furnished by the cure agents. The equivalents of active hydrogen of the cure agent in the form of OH or $HN_2$ groups to the equivalent of the prepolymer in terms of —NCO groups should be in a ratio of about 0.5 to 2.0 and preferably about 1.0.

The polymeric polyisocyanate in the composition of Tables B and D functions as an adhesion promoter and should be omitted when the composition of Table D is used with curing agents because the polymeric polyisocyanate prematurely reacts with the curing agents.

A formulation which provides a satisfactory top coat composition is set forth in Table E:

TABLE E

| COMPONENT | PERCENT | FUNCTION |
|---|---|---|
| Accrowax C | 1.17 | Anti-Block |
| Zirconium Wax Complex | .29 | Water Repellant |
| Decabromodiphenyl Oxide | 11.71 | Flame Retardant |
| Di (2-ethylhexyl phthalate) | 20.26 | Plasticizer |
| Pigment System (infra red Green or White | 7.13 | Color and infra red properties |
| Barium Cadmium Zinc Complex | .64 | Stabilizer |
| Wetaid 35-B | .43 | Dispersion Agent |
| Polyvinyl Chloride Polymer | 21.56 | Flame Retardant Binder |
| Fumed Silica | 1.29 | Thickening Agent |
| Epoxy Resin | .64 | Stabilizer |
| Chlorinated Paraffin | 5.50 | Flame Retardant |

TABLE E-continued

| COMPONENT | PERCENT | FUNCTION |
|---|---|---|
| (40% Chlorine) | | Plasticizer |
| Chlorinated Paraffin (70% Chlorine) | 2.43 | Flame Retardant |
| Antimony Oxide | 23.16 | Flame Retardant |
| Zinc Oxide | 2.14 | Stabilizer & Mildew Inhibitor |
| | 100.00 | |

The compositions of Tables A through E are shown without solvent carriers.

The pigments in the compositions, may, of course, be of any desired color. It has been found desirable in making tents for military usage to make one side green or olive drab and the other side of the fabric white. Combinations of camouflage print on one side and solid infra red reflective color on the other side will also be available. For purposes of illustration, the colors green and white will be used in describing one way of applying the base coats and top coats to both sides of the substrate.

A white base coat is applied with a floating knife to one side of the substrate. The thus coated fabric is framed and dried at 300° F. The target weight of the white base coat is 0.5 ounces per square yard. After drying, a white top coat of Table E is applied on the white base coat with a floating knife. The coated fabric is framed and dried at 300° F. The target weight of the white top coat is 1 ounce per square yard.

A green base coat is next applied to the opposite side of the substrate with a floating knife and the fabric is again framed and dried at 300° F. The target weight of the green base coat is 0.5 ounce per square yard. The final coating is a green top coat on the green base coat. The green top coat is also applied with a floating knife and the fabric is again framed and dried at 300° F. The target weight of the green top coat is 1 ounce per square yard. The total weight of the substrate and the double coating on both sides is 6 to 7 ounces per square yard.

The foregoing example is illustrative only and the coatings may be combined and applied in any desired manner.

Efforts have been made to arrive at an all urethane binder system which would achieve the higher levels of performance, protection and appearance (i.e. non-crazing) required for the end use. None of these efforts were successful until companion coats of polymer binder systems, which contribute to flame retardancy, were utilized. Polyvinyl chloride polymers are the preferred companion polymer system.

Experience has shown the criticality of using the composition of Table E as a top coat instead of a base coat. In one experiment the top coat of Exhibit E was used as the base coat on both sides of a substrate and the base coat of Table A was used as the top coat in the experiment. The resulting fabric was testing using Test Method 5905 and failed the foregoing flame test.

In another experiment the base coat of Table B was used as the top coat after the top coat of Table E had been applied as the base coat to both sides of a substrate. Again, the resulting fabric failed the flame test.

The satisfactory production test results of a fabric coated with the base coat of Table A and with the top coat of Table E are shown in Table F:

TABLE F

| Test | | Test Result | Target Requirement | Federal Test Method 191A Unless Otherwise Noted |
|---|---|---|---|---|
| Width (inches) | | 61⅛ | To Be established | 5020 |
| Yarns Per Inch | MD | 41 | To Be established | 5050 |
| | CD | 40 | To Be Established | 5050 |
| Weight (ounces per square yard) | | 6.19 | 4–7 | 5041 |
| Breaking Strength (pounds) | MD | 234 | 104 Minimum | 5100 |
| | CD | 166 | 88 Minimum | 5100 |
| Tearing Strength (pounds-Elmendorf) | MD | 11.4 | 6.0 Minimum | ASTM-D-1424 |
| | CD | 6.3 | 6.0 Minimum | ASTM-D-1424 |
| Spray Rating (Initial) | | 100 | 80 Minimum | 5226 |
| Hydrostat Ht. (cm) | | | | |
| Initial: | | 79.5 | 45 Minimum | 5514 |
| After cold crack (−40° F.) | | 45.2 | 25 Minimum | 5514 |
| Appearance after cold crack | No visible cracks | | No visible cracks | |
| Flame Test | | | | 5903 |
| Initial: | | | | |
| After Flame (Seconds) | MD | 1.0 | 2.0 Maximum | |
| | CD | 0.0 | 2.0 Maximum | |
| Char Length (inches) | MD | 4.8 | 5.0 Maximum[1] | |
| | CD | 4.4 | 5.0 Maximum[1] | |
| After 3 Washes (5556): | | | | |
| After Flame (seconds) | MD | 0.0 | 2.0 Maximum | |
| | CD | 0.0 | 2.0 Maximum | |
| Char Length (inches) | MD | 4.8 | 5.0 Maximum[1] | |
| | CD | 5.0 | 5.0 Maximum[1] | |
| Flame Test | | | | 5905 |
| Initial: | | | | |
| After Flame (Seconds) | MD | 1.0 | 2.0 Maximum | |
| | CD | 0.0 | 2.0 Maximum | |
| Percent Consumed | MD | 39.6 | 50% Maximum | |
| | CD | 44.0 | 50% Maximum | |
| Crock | | | | |
| Dry | | 4–5 | 2.0 Minimum | 5651 |
| Wet | | 3–4 | 2.0 Minimum | 5651 |
| Flexibility (inch/lbs.) | | | | 5202 |
| Initial | MD | .001 | To Be established | |
| | CD | .001 | To Be established | |
| At −20° F. | MD | .006 | To Be Established | |
| | CD | .004 | To Be Established | |

TABLE F-continued

| Test | | Test Result | Target Requirement | Federal Test Method 191A Unless Otherwise Noted |
|---|---|---|---|---|
| After Heat Aged 200 to 220° F. | MD | .001 | To Be Established | |
| | CD | .001 | To Be Established | |

[1]It is expected that the char length requirements for lightweight synthetics will be adjusted upwardly.

The satisfactory production test results of a fabric coated with the base coat of Table B and the top coat of Table E are shown in Table G:

TABLE G

| Test | | Test Result | Target Requirement | Federal Test Method 191A Unless Otherwise Noted |
|---|---|---|---|---|
| Width (inches) | | 61⅛ | To Be Established | 5020 |
| Yarns Per Inch | MD | 40 | To Be Established | 5050 |
| | CD | 39 | To Be Established | 5050 |
| Weight (ounces per square yard) | | 6.4 | 4–7 | 5041 |
| Breaking Strength (pounds) | MD | 204 | 104 Minimum | 5100 |
| | CD | 164 | 88 Minimum | 5100 |
| Tearing Strength (pounds-Elmendorf) | MD | 10.4 | 6.0 Minimum | ASTM-D-1424 |
| | CD | 8.8 | 6.0 Minimum | ASTM-D-1424 |
| Spray Rating - Initial: | | 100 | 80 Minimum | 5226 |
| Hydrostat Height (cm) | | | | |
| Initial: | | 80.0+ | 45 Minimum | 5514 |
| After Cold Crack (−40° F.) | | 67.3 | 25 Minimum | 5514 |
| Flame Test | | | | 5903 |
| Initial: | | | | |
| After Flame (Seconds) | MD | 00.0 | 2.0 Maximum | |
| | CD | 00.0 | 2.0 Maximum | |
| Char Length (inches) | MD | 5.3 | 5.0 Maximum[1] | |
| | CD | 5.4 | 5.0 Maximum[1] | |
| After 3 Washes (5556): | | | | |
| After Flame (Seconds) | MD | 0.00 | 2.0 Maximum | |
| | CD | 0.00 | 2.0 Maximum | |
| Char Length (inches) | MD | 5.00 | 5.0 Maximum[1] | |
| | CD | 5.60 | 5.0 Maximum[1] | |
| Flame Test | | | | 5905 |
| Initial: | | | | |
| After Flame (Seconds) | MD | 1.00 | 2.0 Maximum | |
| | CD | 1.00 | 2.0 Maximum | |
| Percent Consumed | MD | 42.5 | 50% Maximum | |
| | CD | 40.3 | 50% Maximum | |
| Flexibility (inch/lbs.) | | | | 5202 |
| Initial: | MD | .001 | To Be Established | |
| | CD | .001 | To Be Established | |
| At −20° F. | MD | .002 | To Be Established | |
| | CD | .002 | To Be Established | |
| After Heat Aged 200 to 220° F. | MD | .001 | To Be Established | |
| | CD | .001 | To Be Established | |
| Crock: | | | | |
| Dry | | 3–4 | 2.0 Minimum | 5651 |
| Wet | | 2.0 | 2.0 Minimum | 5651 |

[1]It is expected that the char length requirements for lightweight synthetics will be adjusted upwardly.

The base coat and top coat are used on both sides of the substrate because of the difficulty in getting the desired flame retardant properties with urethane. The urethane base has been found to provide the requisite binder necessary for the strength and durability of the fabric.

Although specific terms have been used in describing the invention, they are used in a descriptive and generic sense only and not for purposes of limitation.

We claim:

1. A coated fabric which is tear resistant, abrasion resistant, water repellant, and flame retardant, said fabric comprising a substrate woven from yarns of nylon fibers, a base coat containing a polyurethane adhesion binder and flame retardants on each surface of the substrate, a top coat overlying the base coat on each surface of the substrate, each said top coat containing flame retardants, a flame retardant binder and a water repellant, and said coated fabric weighing less than 7 ounces per square yard.

2. A multi-coat tent fabric weighing less than seven (7) ounces per square yard and comprising a substrate formed from nylon fibers, a first base coat and a first top coat on one surface of the substrate, a second base coat and a second top coat on the other surface of the substrate, said first base coat and said second base coat each including fire retardant chemicals and a polyurethane adhesion binder, and the first top coat and second top coat each including fire retardant chemicals and a polyvinyl chloride flame retardant binder.

3. A coated fabric comprising a substrate formed from nylon fibers and a base coat and a top coat of flame retardants and binders, including an adhesion binder enveloping the substrate to provide a fabric weighing no more than 7 ounces per square yard and having the following functional properties:

(a) breaking strength of at least 88 lbs. as determined by Federal Test Method 5100, (b) tearing strengh of at least 6 lbs. (Elmendorf) as determined by the testing procedure of ASTM-D-1424, (c) an after-flame burning of the fabric before washing of less than 2 seconds and a char length of the fabric before washing of no more than 7 inches when tested according to Federal Test Method 5903, (d) after-flame burning of no more than 2 seconds after the fabric is washed according to Method 5556 and a char length of no more than 7 inches when tested according to Federal Test Method No. 5903, and (e) after-flame burning of no more than 2 seconds and a flame consumption of no more than 50% of the fabric when tested according to Federal Test Method No. 5905.

4. A coated fabric according to claim 3 wherein said adhesion binder is polyether urethane and the flame retardant binder is a polyvinyl cholride polymer.

5. A coated fabric according to claim 3 wherein the flame retardant chemicals include antimony oxide and decabromodiphenyl oxide.

6. A coated fabric according to claim 3 wherein the synthetic fibers are nylon and the substrate is woven with about 38 yarns per inch in the warp and about 38 yarns per inch in the filling.

7. A coated fabric according to claim 3 wherein the adhesion binder is a urethane and wherein the flame retardant binder is polyvinyl chloride.

8. A method of making a coated fabric having tear resistance, abrasion resistance, water repellance and flame retardance sufficient for use as military tentage and weighing less than 7 ounces per square yard, said method comprising the steps of:

(a) providing a substrate formed from nylon fibers, (b) providing a first liquid composition including flame retardants and a polyurethane adhesion binder, (c) providing a second liquid composition including flame retardants, a flame retardant binder, and a water repellant, (d) applying the first liquid composition as a base coat to both surfaces of the substrate, (e) drying the base coats at an elevated temperature, (f) applying the second liquid composition as a top coat overlying the base coat on both surfaces of the substrate, and (g) drying the second liquid composition on the fabric at an elevated temperature.

9. A method according to claim 8 wherein the polymeric binder in the first liquid composition is polyether urethane.

10. A method according to claim 8 wherein the polymeric binder in the first liquid composition is polyether urethane and the flame retardant binder in the second composition is polyvinyl chloride.

11. A method according to claim 8 wherein the polymeric binder in the first liquid composition is polyester urethane and the flame retardant binder in the second composition is polyvinyl chloride.

12. A method according to claim 8 wherein the adhesion binder is a blocked polyester/polyurethane prepolymer, the flame retardant binder is a polyvinyl chloride polymer, and the base coats and top coats are dried at a temperature of about 300° F.

* * * * *